US006069452A

United States Patent [19]

Rössner

[11] Patent Number: 6,069,452

[45] Date of Patent: May 30, 2000

[54] CIRCUIT CONFIGURATION FOR SIGNAL TRANSMITTERS WITH LIGHT-EMITTING DIODES

[75] Inventor: Holger Rössner, Crystal, Singapore

[73] Assignee: Siemens Aktiengesellschaft, Munich, Germany

[21] Appl. No.: 09/227,672

[22] Filed: Jan. 8, 1999

Related U.S. Application Data

[63] Continuation of application No. PCT/DE97/01434, Jul. 8, 1997.

[30] Foreign Application Priority Data

Jul. 8, 1996 [DE] Germany ..... 196 27 475

[51] Int. Cl.[7] ..... H05B 37/00

[52] U.S. Cl. ..... 315/192; 315/185 R; 315/135; 340/907; 340/825.82

[58] Field of Search ..... 315/192, 169.3, 315/312, 185 R, 135, 53; 362/800; 340/907, 825.79, 825.82; 345/83, 208

[56] References Cited

U.S. PATENT DOCUMENTS

| | | | |
|---|---|---|---|
| 3,869,641 | 3/1975 | Goldberg | 315/135 |
| 4,211,955 | 7/1980 | Ray | 315/53 |
| 4,298,869 | 11/1981 | Okuno | 340/782 |
| 4,329,625 | 5/1982 | Nishizawa et al. | 315/158 |
| 4,755,807 | 7/1988 | Guennou | 345/83 |
| 4,939,426 | 7/1990 | Menard et al. | 315/192 |

FOREIGN PATENT DOCUMENTS

| | | |
|---|---|---|
| 2350034 | 11/1977 | France . |
| 3230975A1 | 2/1984 | Germany . |
| 2941634C3 | 4/1985 | Germany . |
| 3642251A1 | 7/1987 | Germany . |

*Primary Examiner*—Haissa Philogene
*Attorney, Agent, or Firm*—Herbert L. Lerner; Laurence A. Greenberg; Werner H. Stemer

[57] ABSTRACT

A circuit configuration for emitting light signals in a road traffic systems. A plurality of LEDs for emitting colored light are supplied with an a.c. voltage. The LEDs are arranged in two groups of LEDs which are connected antiparallel to one another. Two respective LEDs of the two groups are disposed together in a housing and the groups are cross-connected to form a multiply redundant matrix. An intrinsically safe signal transmitter configuration is provided that is simple and can easily be monitored.

7 Claims, 1 Drawing Sheet

CIRCUIT CONFIGURATION FOR SIGNAL TRANSMITTERS WITH LIGHT-EMITTING DIODES

CROSS-REFERENCE TO RELATED APPLICATION

This is a continuation of copending international application PCT/DE97/01434, filed Jul. 8, 1997, which designated the United States.

BACKGROUND OF THE INVENTION

Field of the Invention

The invention relates to a circuit configuration for signal transmitters with light-emitting diodes (LEDs) for emitting colored light. The LEDs are arranged in an electrical circuit supplied with an a.c. voltage. One group of the LEDs is connected antiparallel to a second group of LEDs. The LEDs are arranged in electrical sections which are connected antiparallel to one another, and only LEDs of one group are arranged in each section, and the two groups of LEDs are driven by the two a.c. phases. The invention relates, in particular, to such a circuit configuration for signal transmitters in road traffic signal systems.

To date, a customary incandescent bulb has been used in road traffic signal systems or traffic lights for the purpose of generating colored light. A colored filter plate is disposed in front of the bulb. It is disadvantageous in that case, however, that other light sources may reflect on the colored filter plate of an otherwise switched-off traffic light. The reflection may illuminate the plate and it may not be clear whether the corresponding signal is switched on or off. A further disadvantage in the use of incandescent bulbs is that the latter emit light in a broadband radiation spectrum and only a small percentage is filtered out in the desired color and, as a result, only a fraction of the energy used is utilized.

These disadvantages are eliminated by using LEDs (Light Emitting Diodes) as a radiation source. The LEDs produce virtually monochromatic light in the desired color and therefore do not require any filters which can cause the deceptive reflection described above. In addition, almost 100% of the energy generated is converted into light of the desired color when LEDs are used.

To date, the use of LEDs, also known as light-emitting diodes, in traffic light systems has been effected only in prototypes and is still subject to a number of problems. In this case, the LEDs are operated using a ballast comprising a power supply unit, possibly a regulator and also, under certain circumstances, a pulse generator for pulse control operation of the LEDs. It is thereby problematic that the components used in the ballasts, in accordance with DIN 0832, do not comprise fault exclusions. Therefore, the ballasts cannot be regarded as an intrinsically safe assembly. For this reason, and because the ballasts are so complex in their entirety that internal monitoring can no longer be carried out reliably, it is necessary to use sensors to measure or meter an inhibit or stop signal, in particular. A red light is usually used as the stop signal in traffic light systems. Complex ballasts of this type, which additionally require a failure recognition configuration, can only be produced with high costs.

U.S. Pat. No. 4,939,426 discloses an array with a plurality of rectified LEDs arranged in sections. Two such sections are connected antiparallel to one another. Each section is driven alternately by the two a.c. phases when an a.c. voltage is applied. This has the disadvantage that when a single LED fails, the entire associated section becomes nonfunctional, with the result that flickering light is produced.

French patent application FR A 2 350 034 describes a system in which a plurality of sections of rectified LEDs are disposed next to one another. Within that arrangement of sections containing rectified LEDs, junction points between two LEDs of one section are, in each case, connected to a junction point between LEDs of a neighboring section in order to form a matrix.

SUMMARY OF THE INVENTION

It is accordingly an object of the invention to provide a circuit for a signal transmitter with light emitting diodes, which overcomes the above-mentioned disadvantages of the heretofore-known devices and methods of this general type and which improves the reliability of the system while the luminosity is maintained as far as possible unchanged.

With the foregoing and other objects in view there is provided, in accordance with the invention, a circuit configuration, comprising:

- an electrical circuit supplied with an a.c. voltage having two a.c. phases;
- a plurality of LEDs for emitting colored light connected in the electrical circuit, the plurality of LEDs being arranged in a matrix of LEDs including a first group of LEDs and a second group of LEDs;
- the LEDs being arranged in electrical sections connected antiparallel to one another and each including only LEDs of the first or second group, respectively, such that the first group of LEDs is connected antiparallel to the second group of LEDs;
- the first and second groups of LEDs being respectively driven by the two a.c. phases;
- an LED of the first group of LEDs and an LED of the second group of LEDs being disposed in a combined housing; and
- cross-connections interconnecting the electrical sections at all junction nodes between the LEDs, defining a multiply redundant matrix of LEDs.

In other words, in each case one LED of the first group is combined with an LED of the second group, the latter LED being operated antiparallel with the former LED, in a housing. Further, at least one junction point between two LEDs of the first group is connected to at least one junction point between two LEDs of the second group by a cross-connection line.

In accordance with an alternative solution, which is applied particularly when the LEDs permit only a low reverse voltage, the LEDs are arranged in an electrical circuit which is supplied with an a.c. voltage and in which at least one bridge rectifier is arranged, by which the LEDs are driven.

According to a fundamental concept of the invention, the LEDs are operated antiparallel from an a.c. voltage via a series resistor. Although each LED illuminates only for half a period, which could lead to discernible flickering at a power supply frequency, this effect is avoided by the antiparallel connection of the groups of LEDs. As a result, there are virtually no dark intervals for the overall module. It is possible, according to DIN 0832, to assert fault exclusions for the alternatively required components, such as the bridge rectifier for example.

The effect that is advantageously achieved by the measure of combining in each case two LEDs operated antiparallel in a housing is that the number of components is reduced. It is advantageous that jumping of light spots is likewise reduced as a result, since the LEDs emitting the same color are so close together that outwardly they appear to be one luminous spot in each case. The residual flickering between different luminous spots would then have a frequency of 100 Hz, which is imperceptible to a human observer. So-called MULTILEDs, for example, can be used for this purpose (MULTILED is a registered trademark of Siemens AG).

Each of the two groups of LEDs comprises a plurality of electrical sections which are connected in parallel and each have a plurality of series-connected LEDs. These electrical sections are interconnected at all the junction points of the individual LEDs.

Altogether, then, a grid or array is produced and can be classified as multiply redundant as a result of this and also on account of the various electrical LED sections being connected in parallel.

In a preferred embodiment of the invention, a diffusing screen is fitted in front of the LEDs and prevents flickering caused by luminous spots jumping back and forth which is possibly discernible to the observer, since the diffusing screen makes it impossible for the observer to locally assign the visible light.

In accordance with an added feature of the invention, the first group of LEDs contains a number of LEDs equal to a number of LEDs in the second group of LEDs. This means that in each case half the number of LEDs used in the circuit configuration are operated antiparallel with the remaining LEDs of the circuit configuration, with the result that the same number of LEDs illuminate in both half-cycles of the a.c. voltage.

In accordance with an additional feature of the invention, a transformer supplies the electrical circuit with an a.c. voltage of between 10 and 40 V during operation of the circuit configuration. The a.c. voltage is produced by the transformer which steps down a power supply voltage of 110 V (or 220 V) to a supply voltage of between 10 and 40 V. A fault exclusion according to DIN 0832 can also be asserted for the transformer. The a.c. voltage is also favorable insofar as the advantages of pulse control operation can also be accepted since the half-cycle of a sinusoidal a.c. voltage can lead to similar effects to those of a square-wave pulse. This is favorable since a higher luminous efficiency can be obtained with pulse control operation of the LEDs than with DC operation.

In accordance with another feature of the invention, semiconductor diodes for protecting the LEDs are connected into the electrical sections. Alternatively, a bridge rectifier may be inserted into each individual section. Such a bridge rectifier may also be connected upstream of the entire LED array. These measures are advantageous particularly when the LEDs permit only a low reverse voltage.

In accordance with a further feature of the invention, a series resistor is connected in the electrical circuit.

In accordance with again a further feature of the invention, each junction node formed between two LEDs of one section is in each case connected to exactly one junction node between two LEDs of every other section by means of a respective cross connection.

In accordance with a concomitant feature of the invention, the matrix of LEDs define a traffic light in a traffic control system.

In the primary electrical circuit, current monitoring is possible in a simple manner, with the result that a complex ballast is not required.

From an overall standpoint, it is possible to assert fault exclusions, in accordance with DIN 0832, for the transformer and the series resistor. The semiconductor diodes and, if appropriate, the bridge rectifiers are present multiply, exactly like the LED sections, and are thus multiply redundant as well.

Other features which are considered as characteristic for the invention are set forth in the appended claims.

Although the invention is illustrated and described herein as embodied in a circuit configuration for signal transmitters having light-emitting diodes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
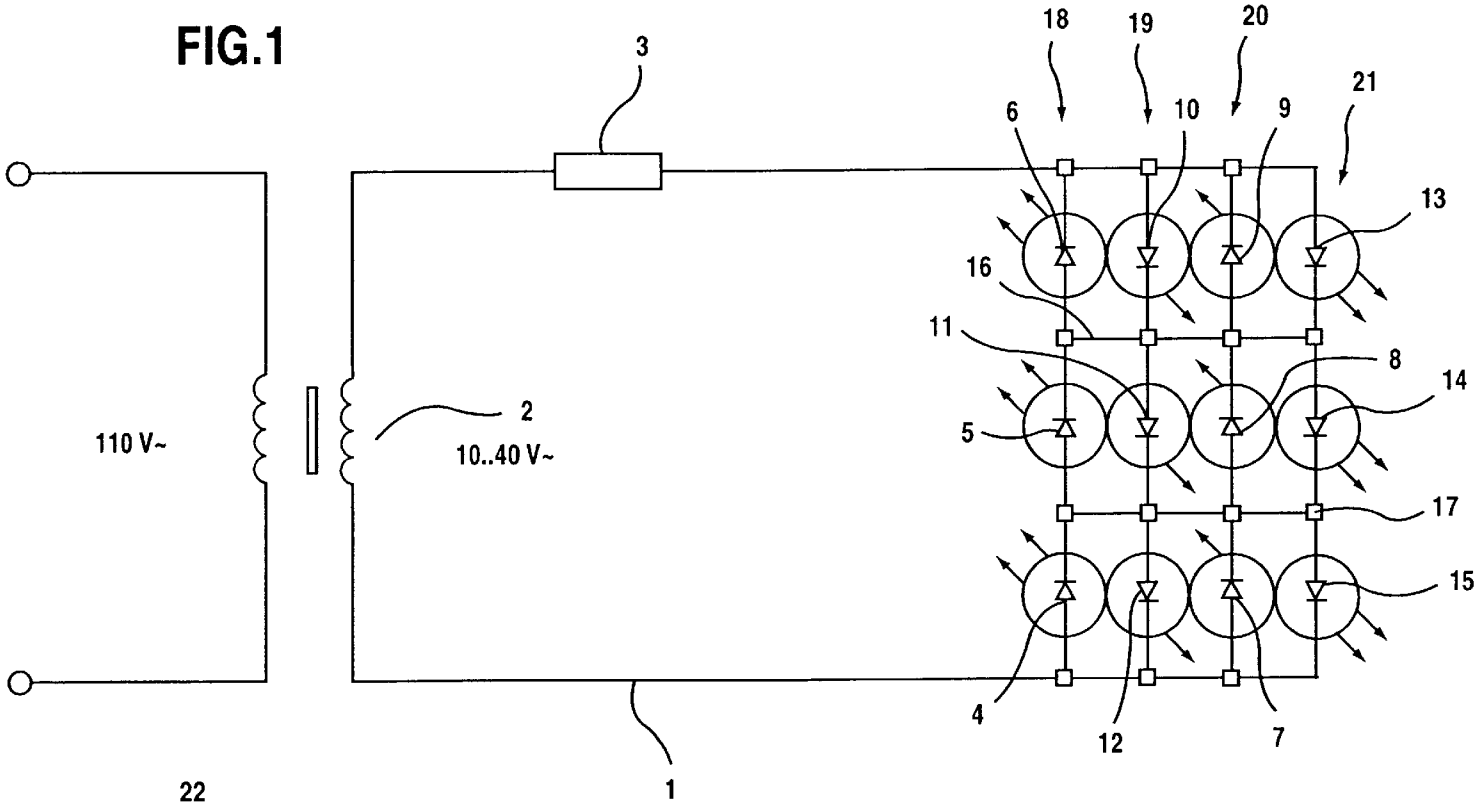
FIG. 1 is a schematic diagram of an exemplary embodiment of the invention.

Referring now to the figures of the drawing in detail and first, particularly, to FIG. 1 thereof, there is seen a secondary-side electrical circuit 1, a transformer 2, a series resistor 3, twelve LEDs 4 to 15 and cross connections 16 and 17. Overall, six LEDs 4 to 9 and six LEDs 10 to 15 respectively form a first and a second group of LEDs, which are connected antiparallel (back-to-back) to one another, that is to say the forward direction of the LEDs 4 to 9 of the first group is in the opposite direction in the electrical circuit to that of the LEDs 10 to 15 of the second group. Each group comprises a plurality of parallel-connected sections 18, 19, 20, 21 of LEDs which are connected in series and in the same forward-biased direction. For example, the LEDs 4, 5 and 6 form a section 18 of the first group and are connected antiparallel to the section 19 having the LEDs 10, 11 and 12 of the second group. By means of electrical cross connections 16 and 17 between junction nodes of the individual LEDs of one section 18, 19, 20, 21, the individual sections 18, 19, 20, 21 are also interconnected and thus form an array or a matrix. In this case, each junction point between two LEDs of one section 18, 19, 20, 21 is preferably in each case connected to exactly one junction point between in each case two LEDs of every other section by means of such cross connections. Of course, it is also conceivable for in each case two sections connected antiparallel to one another to have cross connections only between themselves and for the pairs of sections formed as a result to be interconnected only in parallel and to have no cross connections.

One group of LEDs is driven by one half-cycle of the alternating current and the other group is driven by the other half-cycle.

Figure 2:
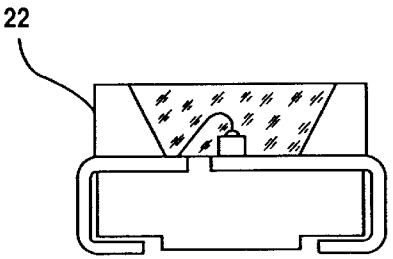
FIG. 2 is a diagrammatic elevational view of an LED housing.

Referring now to FIG. 2, components may be used which each combine two LEDs in one LED housing. Such components are known, for example, as a MULTILED-SMD housing 22 (registered trademark of Siemens AG). The LEDs 4 and 12, 5 and 11, and 9 and 13, for example, are then combined to form one component having two chips of the same color.

The electrical circuit 1 is supplied with an a.c. voltage of 10 to 40 V by the transformer 2 for the operation of the LEDs 4 to 15. The primary-side 220 V alternating current of the voltage supply is consequently located outside the LED circuit configuration.

I claim:

1. A circuit configuration, comprising:

an electrical circuit supplied with an a.c. voltage having two a.c. phases;

a plurality of LEDs for emitting colored light connected in said electrical circuit, said plurality of LEDs being arranged in a matrix of LEDs including a first group of LEDs and a second group of LEDs;

said LEDs being arranged in electrical sections connected antiparallel to one another and each including only LEDs of said first or second group, respectively, such that said first group of LEDs is connected antiparallel to said second group of LEDs;

said first and second groups of LEDs being respectively driven by the two a.c. phases;

an LED of said first group of LEDs and an LED of said second group of LEDs being disposed in a combined housing; and cross-connections interconnecting said electrical sections at all junction nodes between said LEDs, defining a multiply redundant matrix of LEDs.

2. The circuit configuration according to claim 1, wherein said first group of LEDs contains a number of LEDs equal to a number of LEDs in said second group of LEDs.

3. The circuit configuration according to claim 1, which comprises a transformer supplying said electrical circuit with an a.c. voltage of between 10 and 40 V during operation of the circuit configuration.

4. The circuit configuration according to claim 1, which comprises semiconductor diodes for protecting said LEDs connected into said electrical sections.

5. The circuit configuration according to claim 1, which comprises a series resistor connected in said electrical circuit.

6. The circuit configuration according to claim 1, wherein each junction node formed between two LEDs of one section is in each case connected to exactly one junction node between two LEDs of every other section by means of a respective said cross connection.

7. The circuit configuration according to claim 1, wherein said matrix of LEDs define a traffic light in a traffic control system.

* * * * *